US005867862A

United States Patent [19]

Ahlf et al.

[11] Patent Number: 5,867,862

[45] Date of Patent: Feb. 9, 1999

[54] VACUUM CLEANING APPLIANCE WITH TELESCOPIC HANDLE

[75] Inventors: Heinz Jürgen Ahlf, Bergisch-Gladbach; Ludger Helmes, Velbert; Rolf Strohmeyer, Remscheid, all of Germany

[73] Assignee: Vorwerk & Co. Interholding GmbH, Wuppertal, Germany

[21] Appl. No.: 652,603

[22] PCT Filed: Nov. 23, 1994

[86] PCT No.: PCT/EP94/03867

§ 371 Date: Aug. 1, 1996

§ 102(e) Date: Aug. 1, 1996

[87] PCT Pub. No.: WO95/15111

PCT Pub. Date: Jun. 8, 1995

[30] Foreign Application Priority Data

Dec. 2, 1993 [DE] Germany ..... 93 18 460 U

[51] Int. Cl.[6] ..... A47L 9/32

[52] U.S. Cl. ..... 15/329; 15/144.4; 15/410

[58] Field of Search ..... 15/410, 329, 144.4

[56] References Cited

U.S. PATENT DOCUMENTS

| | | | |
|---|---|---|---|
| 2,986,765 | 6/1961 | Ernolf et al. | 15/329 |
| 3,758,914 | 9/1973 | Nupp et al. . | |
| 4,319,380 | 3/1982 | Simm et al. | 15/410 |
| 4,662,026 | 5/1987 | Sumerau et al. | 15/329 |
| 4,876,763 | 10/1989 | Cho et al. | 15/329 |
| 4,989,295 | 2/1991 | Guhne et al. | 15/410 |
| 5,016,315 | 5/1991 | Bledsoe et al. | 15/410 |
| 5,083,340 | 1/1992 | Takahashi et al. | 15/410 |
| 5,086,536 | 2/1992 | Lackner et al. | 15/410 X |

FOREIGN PATENT DOCUMENTS

| | | | |
|---|---|---|---|
| 2025832 | 9/1970 | France . | |
| 2453236 | 5/1976 | Germany . | |
| 3903451 | 8/1990 | Germany | 15/410 |
| 4032899 | 4/1992 | Germany | 15/410 |

OTHER PUBLICATIONS

Patent Abstracts of Japan, vol. 16, No. 334 (C–09640 Jul. 21, 1992 & JP,A, 04 097 718 (Matsushita Electric Ind Co) Mar. 30, 1992 see abstract.

Patent Abstracts of Japan, vol. 17, No. 93 (C–1029) 24, Feb. 1993 & JP, A,04 285517 (Sanyo Electric Co. Ltd) 9 Oct. 1992 see abstract.

Patent Abstracts of Japan, vol. 16, No. 164 (C–0931) 21, Apr. 1992 & JP,A,04 012 721 (Mitsubishi Electric Home Appliance Co. Ltd) 17 Jan. 1992, see abstract.

Patent Abstracts of Japan, vol. 17, No. 232 (C–1056) 12, May 1993 & JP,A,04 364 822 (Sharp Co) 17, Dec. 1992, see abstract.

*Primary Examiner*—Chris K. Moore
*Attorney, Agent, or Firm*—Martin A. Farber

[57] ABSTRACT

A vacuum cleaning appliance operated by an electric motor and having a telescopic handle with a hand grip. For greater ease of use, the hand grip is detachable and capable of being attached between a telescopic middle piece and an anchoring point on the handle to the appliance.

8 Claims, 6 Drawing Sheets

5
26
11
24
25
22
12
3
4
21
23
6
19
b
20
a
16

VACUUM CLEANING APPLIANCE WITH TELESCOPIC HANDLE

FIELD AND BACKGROUND OF THE INVENTION

The present invention relates to a vacuum cleaning appliance which is operated by an electric motor and having a telescopic handle which is provided with a hand grip.

Such vacuum cleaners are well known. By means of the telescopic handle, the hand grip can be brought to an ergonomically favorable height of use. For this purpose, the telescopic handle generally has several detent attachment positions which can be released by depressing a lock (-release) button. Furthermore, it is also known to detach such a handle from the vacuum cleaner by a lock button in order to be able to use the handle for another appliance. The location of the hand grip on the free end of a telescopic handle is disadvantageous for various tasks. Thus, for instance, it is difficult to manipulate the vacuum cleaner for work close to the floor. Furthermore, when vacuuming cushions or the like the vacuum cleaner which is provided in this case with a suction hose is very inconvenient to handle.

SUMMARY OF THE INVENTION

The object of the present invention is to develop a vacuum cleaning appliance of this type in such a manner that it is easier to use.

As a result of the development of the invention, a vacuum cleaning appliance of this type is easier to handle. This is due, in particular, to the fact that the hand grip is removable and can be attached between a telescopic middle piece and an anchoring point for the handle on the appliance. When working close to the floor or when vacuuming cushions or the like, the hand grip can be removed from the handle and fastened at a different place on the handle. This is done preferably in the region where the handle enters into the motor housing of the vacuum cleaning appliance. In this way, the handle is arranged close to the center of gravity of the vacuum cleaner, which is an advantage with respect, in particular, to its ease of use. Such an arrangement is that the handle is located between the telescopic middle piece and an anchoring point for the handle on the appliance. For this purpose, the telescopic handle is lengthened in ordinary fashion by means of a locking button, whereupon the hand grip is inserted between the telescopic middle piece and the anchoring point for the handle on the appliance. In this connection, it is also possible that, after the positioning of the hand grip in the indicated region, the telescopic middle piece is pushed back again in the direction towards the anchoring point for the handle, a locking being thereby effected between the hand grip and the telescopic middle piece. This lock also can be opened by a lock button. The hand grip is thus form-locked (held by the shape of the parts) in the region close to the center of gravity of the vacuum cleaner. Particularly when vacuuming cushions, in which case the vacuum cleaner is provided, for instance, with a suction hose, such an arrangement of the hand grip is of particular advantage ergonometrically since particularly in this case the vacuum cleaner is frequently carried and thus the arrangement of the hand grip close to the center of gravity of the vacuum cleaner is favorable. The hand grip can advantageously be arranged on one end of the handle. This arrangement is advantageous, in particular, with ordinary vacuuming of carpets or the like. In this case also, the hand grip is arranged, via a detent, on the end of the handle. The detent can be opened by means of a lock button. In known manner, the telescopic handle can be lengthened so as to permit an ergonomically optimal adaptation to the height of the user. The hand grip which is formed in this manner can be detached from the end of the handle by means of the lock button and, as described above, fastened to the handle at a point closer to the center of gravity. It is particularly advantageous in this connection for the handle to have a stationary base rod on which the telescopic middle piece can be displaced. Upon the displacement of the telescopic middle piece, a free space is formed between the telescopic middle piece and the anchoring point for the handle or of the base rod of the handle, into which space the hand grip can be inserted. In this connection, a form-locked attachment of the hand grip to the base rod of the handle can also be formed. In an advantageous further development, the feeding of current takes place by a cable which extends into the hand grip. In combination with an on/off switch arranged in the hand grip this results in advantageous handling of the vacuum cleaner. This development is furthermore optimized in the manner that the hand grip has at least one plug-like pin for the electrical connection to the telescopic middle piece. The current is in this case supplied via the hand grip which has the current feed and the on/off switch and the telescopic middle piece which is connected by the plug with the hand grip, in which connection the telescopic middle piece has cable loops or the like which are passed through the base rod of the handle into the motor housing. In this way, in every position in length of the telescopic handle the supply of current to the motor of the vacuum cleaner is assured. In this connection, the telescopic middle piece advantageously has a receptacle for the plug-like pin at both ends. The closing of the circuit is thus assured both when the hand grip is arranged on the end of the handle and when it is arranged between the telescopic middle piece and the anchoring point for the handle on the appliance. In this connection, the hand grip can be provided, for instance, with two plug-like pins and the telescopic middle piece at both ends with in each case two corresponding receptacles, similar to a plug-receptacle arrangement. In order to produce a dependable arrangement of the hand grip both on one end of the telescopic middle piece and on its other end, the hand grip has an attachment flange on which the plug-like pin is also formed and the attachment flange is arranged eccentrically with respect to the lengthwise direction of the hand grip. In this connection, the hand grip can be so formed that it is arranged parallel to but offset axially from the handle, the attachment flange of the hand grip being seated in an extension of the handle. This attachment flange can furthermore have a recess which corresponds to the outer contour of the base rod of the handle. In this connection, a fork-shaped development of the attachment flange may be advantageous. It is possible to develop the forked arms so that they are slightly resilient, in which case, upon the placing of the hand grip on the base rod, which is exposed, upon the telescoping of the handle, in the region between the telescopic middle piece and the anchoring point for the handle on the appliance side, said arms clip around the hand grip, whereby a form-lock is already obtained here. If, the telescopic middle piece is then engaged with the handle, as already described, along with which the plug-like pin enters into the corresponding receptacle, an optimal form-lock is obtained. Finally it is also advantageous for the eccentric arrangement to be such that only a slight overlap is formed between the hand grip and the telescopic middle piece. The development is such that the hand grip rests, in the region of the slight lengthwise overlap, with the telescopic middle piece against the outer wall of the middle piece. The substantially larger part of the hand grip, seen in lengthwise direction, extends, when the hand grip is arranged on the end of the handle, beyond the latter, which means a lengthening of the handle. When the hand grip is arranged in the region between the telescopic middle piece and the anchoring point for the handle on the appliance side, the part of the hand grip protruding in the above-described position now rests on the motor housing or the like.

BRIEF DESCRIPTION OF THE DRAWINGS

With the above and other advantages in view, the present invention will become more clearly understood in connection with the detailed description of the preferred embodiment, when considered with the accompanying drawings, of which.

DETAILED DESCRIPTION OF THE PREFERRED EMBODIMENT

Figure 1:
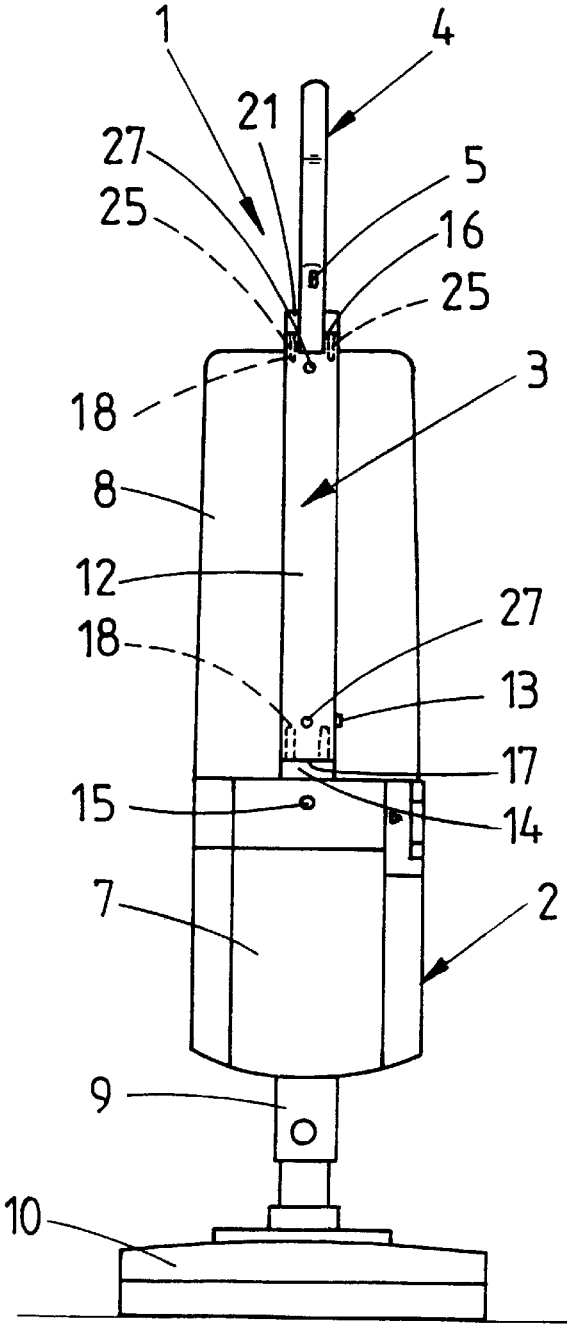
FIG. 1 shows a vacuum cleaning appliance in accordance with the invention in front view, a hand grip being arranged on one end of the handle.

The vacuum cleaner 1 shown is developed as a manually operated appliance. It has a housing 2 adjoining which, towards the top, there is a handle 3 having a hand grip 4 at its end. Within the hand grip 4, there is a thumb-actuated on/off switch 5. The connection for the electric cord or cable 6 is arranged on the end of the hand grip 4 facing the user, opposite the on/off switch 5.

The housing 2 is divided into a motor housing 7 and a chamber 8 extending above it to receive a filter bag. The motor fan has not been shown in detail in the drawing.

The motor housing 7 passes at the bottom into a pipe coupling 9 which provides the air-flow connection to a suction nozzle 10.

The suction nozzle 10 can be a so-called suction/brush nozzle, which contains, within the mouth of the nozzle, a brush roller which is placed in rotation by a separate drive.

The handle 3 is telescopic, it having a stationary base rod 11 on which a telescopic middle piece 12 is displaceable after actuation of a lock button 13. The base rod 11 has an anchoring of the appliance 14 on the end associated with the housing 2, which anchoring can engage in the housing 2. This engagement can also be released by a button 15, so that the entire handle 3 can be removed from the vacuum cleaner 1.

At the two ends 16, 17 of the telescopic middle piece 12, there are two cylindrically shaped receptacles 18 directed in the lengthwise direction of the handle 3. These receptacles 18 serve for feeding the current, they being connected electrically, via cable loops (not shown) arranged within the telescopic handle 3, to the motor which is arranged in the motor housing 7. These cable loops extend from the receptacles 18, passing through the base rod 11, up into the motor housing 7. The receptacles 18 form a coupling for receiving a plug on the hand grip.

Figures 7, 8, 9:
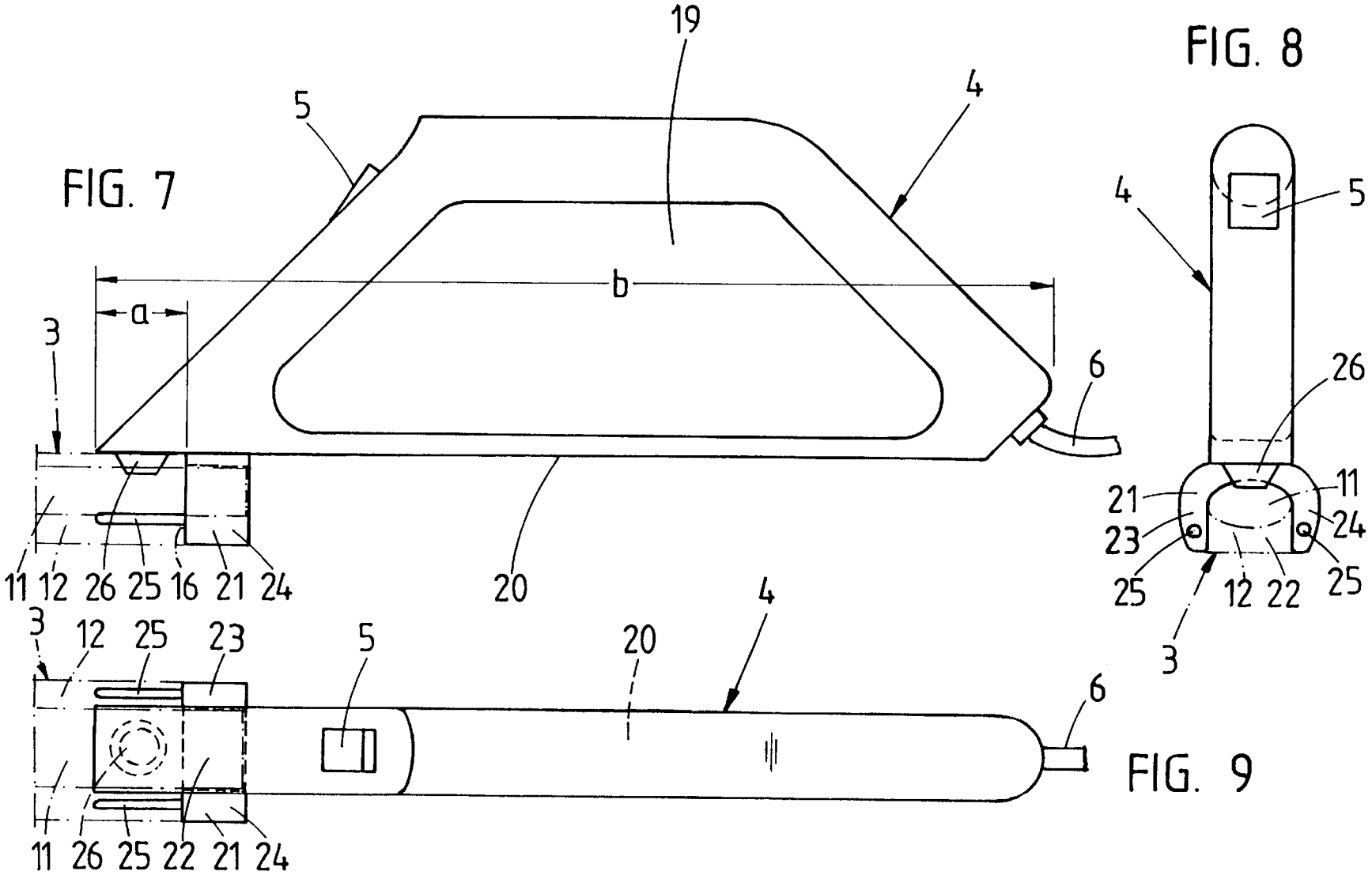
FIG. 7 is a side view of the hand grip.
FIG. 8 is a front view of the hand grip.
FIG. 9 is a top view of the hand grip.

As can be noted in particular from FIG. 7, the hand grip 4 has essentially the shape of half a hexagon and has a correspondingly shaped opening 19 for easier handling. The cross section of the gripping piece formed in this way is substantially circular. The aforementioned on/off switch 5 is arranged in the front end region of the hand grip 4 which can be reached by the thumb.

Said end always faces in the direction of the handle 3 or of the telescopic middle piece 12. On its bottom 20 facing the handle 3, an attachment flange 21 is formed on the hand grip 4. This attachment flange is fork-shaped and has a greater width in the direction transverse to the length of the hand grip 4 than the hand grip 4 does in its gripping region. The width of the attachment flange 21, in its turn, corresponds to the width of the telescopic middle piece 12. The outer contour of the attachment flange 21 also corresponds to that of the telescopic middle piece 12. The pipe receiver 22 formed by the fork shape of the attachment flange 21 has the same width as the base rod 11. Within the region of the fork arms 23, 24 of the attachment flange 21 there is arranged in each case a plug-like pin 25. These pins 25 point in the direction towards the telescopic middle piece 12 provided with the hand grip 4, the pins 25 being connected to the electric cable 6 via the on/off switch 5.

The arrangement of the attachment flange 21 on the hand grip 4 is such that the attachment flange 21 is eccentric with respect to the lengthwise direction of the hand grip 4. In the embodiment shown, the arrangement is specifically such that the attachment flange 21 is eccentric, tending in the direction towards the place of connection to the telescopic middle piece 12. In this way, there results a certain lengthwise overlap a between the hand grip 4 and the telescopic middle piece 12, the ratio of the length of overlap a to the total length b of the hand grip 4 being about 1:12.

The hand grip 4 is on its bottom 20 provided in the overlap region a with a detent projection 26. It serves to lock the hand grip 4 on the telescopic middle piece 12, the latter having, for the unlocking, a corresponding lock button 27 both in the region of the one end of the telescopic middle piece 12 and in the region of the other end thereof.

If the vacuum cleaner 1 is used in traditional manner for the vacuuming of carpets or the like, the hand grip 4 is arranged on the free end of the handle 3. For this purpose, the hand grip 4 is placed on the end 16 of the telescopic middle piece 12, the attachment flange 21 resting against the end 16. In this connection, the pins 25 enter into the corresponding receptacles 18 of the telescopic middle piece 12, whereby the electric connection of the motor arranged in the motor housing 7 is established. Furthermore, the detent projection 26 engages in a corresponding receptacle on the top of the telescopic middle piece 12, the hand grip 4 resting accordingly in the region of its overlap a on the top of the telescopic middle piece 12. In the embodiment shown, the far greater part, namely, seen in the lengthwise direction of the hand grip 4, approximately 10/12th of the hand grip 4 extends in this connection over the end of the handle 3 so that the latter is extended by the hand grip 4. For ease in handling, the telescopic middle piece 12 can now be pushed on the base rod 11, after unlocking by means of the lock button 13, in order to obtain greater ease of use.

Figure 3:
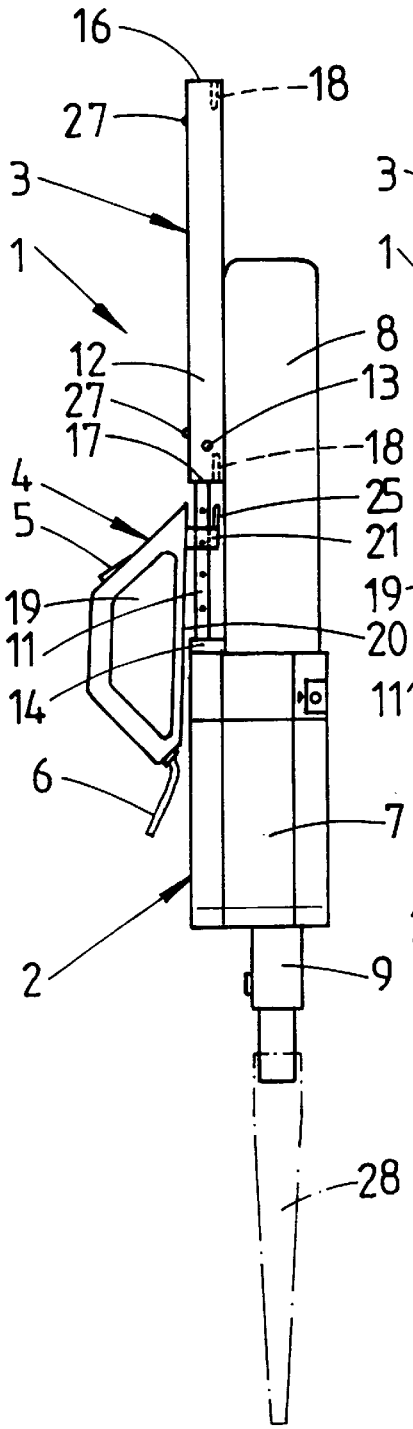
FIG. 3 shows the vacuum cleaning appliance with the hand grip removed from the end of the handle and placed in the region between a telescopic middle piece and an anchoring point for the handle on the appliance.
Figure 4:
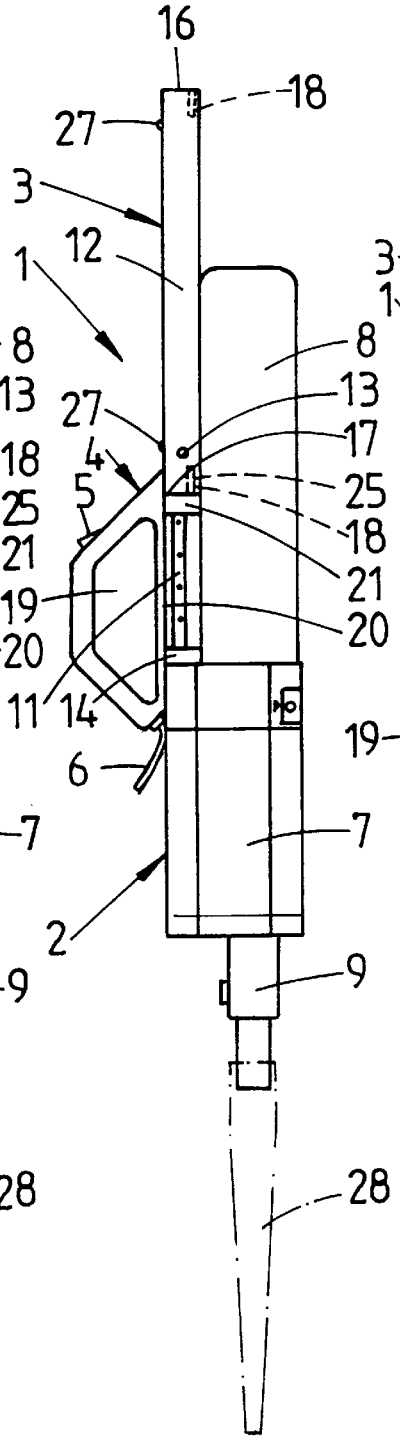
FIG. 4 shows the next step after FIG. 3.
Figure 5:
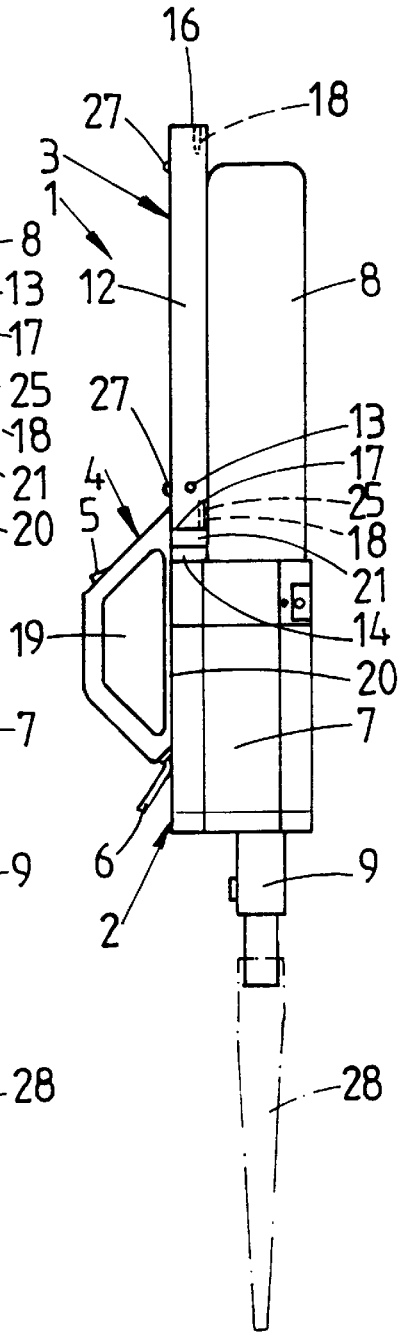
FIG. 5 shows a following step in which the hand grip is fastened between the telescopic middle piece and the anchoring point for the handle.
Figure 6:
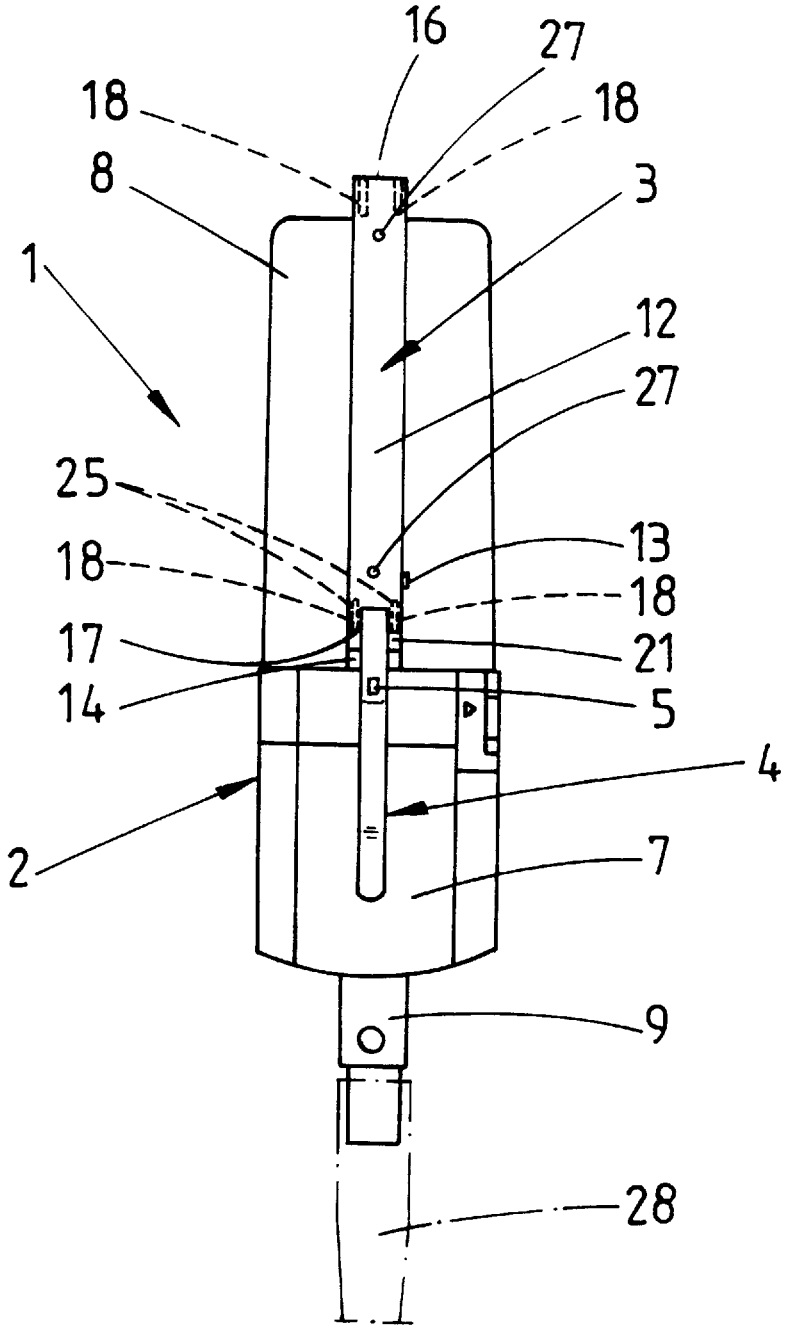
FIG. 6 is a view corresponding to FIG. 1, but with the arrangement of the hand grip in accordance with FIG. 5.

In order to perform, for instance, work close to the floor or to vacuum cushions or the like, it is advisable to remove the hand grip 4 from the free end of the handle 3 and reattach it. This is done most simply by actuating the lock button 27 on the telescopic middle piece 12, as a result of which the hand grip 4 can be removed. The hand grip can now be arranged in the region between the telescopic middle piece 12 and the anchoring point 14 of the base rod 11. This process is shown in FIGS. 3 to 5.

First of all, the telescopic handle 3 is lengthened in the manner that the telescopic middle piece 12 is pulled out on the base rod 11 from the anchoring point 14 after unlocking it by means of the lock button 13. In this way, a free space is formed between the end 17 of the telescopic middle piece 12 and the anchoring point 14, through which space the base rod 11 extends. In the region of this free space, the hand grip 4 is now brought into a position which is turned 180° as compared with its position when arranged on the end of the handle 3, the fork arms 23, 24 of the attachment flange 21 gripping the base rod 11. In this connection, it is also possible to form the fork arms 23, 24 resiliently, providing a back-engagement so as to obtain a form lock (a holding by the shape of the parts) of the attachment flange 21 and the base rod 11. Thereupon the hand grip 4 is pushed in the region of its attachment flange 21 on the base rod 11 in the direction towards the end 17 of the telescopic middle piece 12 until the pins 25 enter into the corresponding receptacles 18 and the detent projection 26 enters into the corresponding receptacle of the telescopic middle piece 12 (see FIG. 4). Finally, the telescopic middle piece 12, together with the hand grip, is pushed back again in the direction towards the anchoring point 14, whereby the telescopic middle piece 12 is engaged in this position with the base rod 11. Here also, an electric connection of the motor to a cable connection 6 is established.

Figure 2:
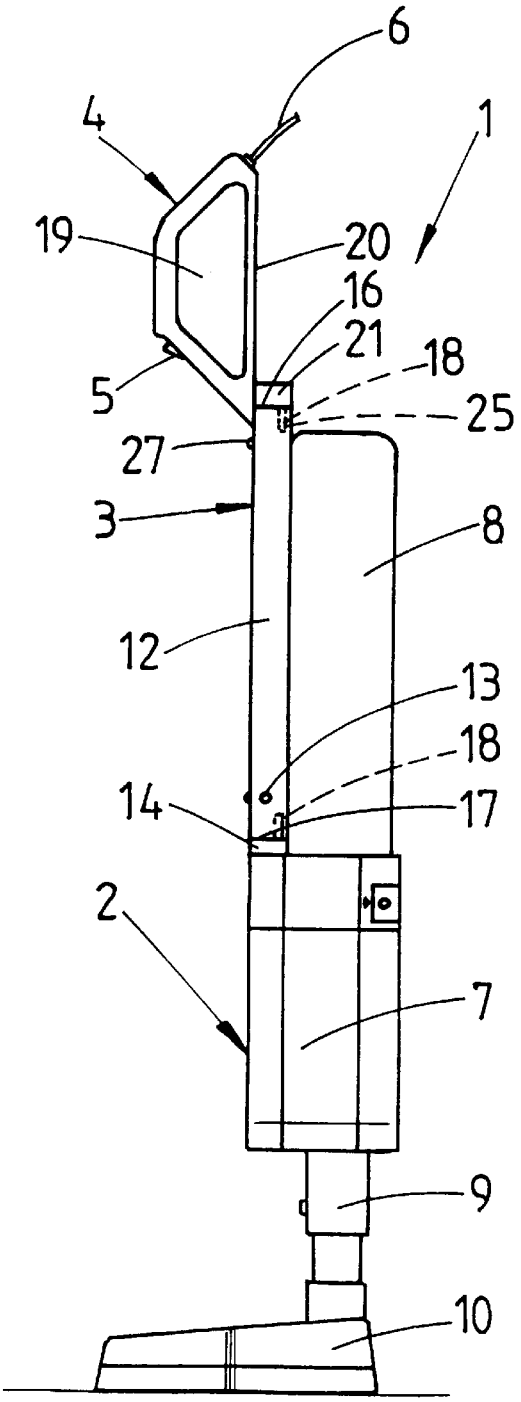
FIG. 2 shows the vacuum cleaning appliance of FIG. 1, in a side view.
Figure 10:
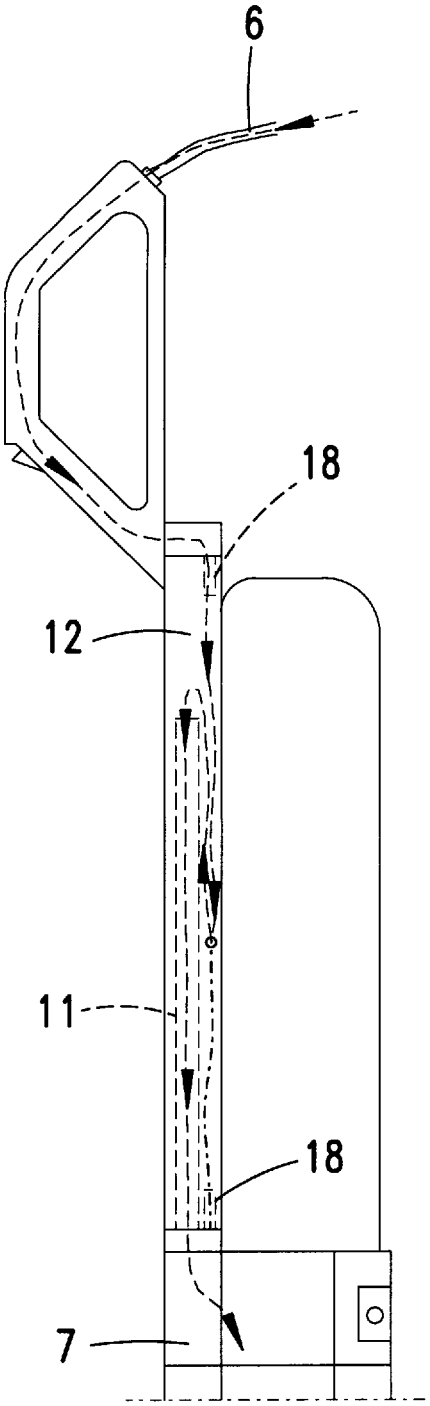
FIG. 10 is a diagrammatic view showing electrical connection between a hand grip via a telescoping handle to a motor housing with the grip located at an end of the handle distant from the motor housing.
Figure 11:
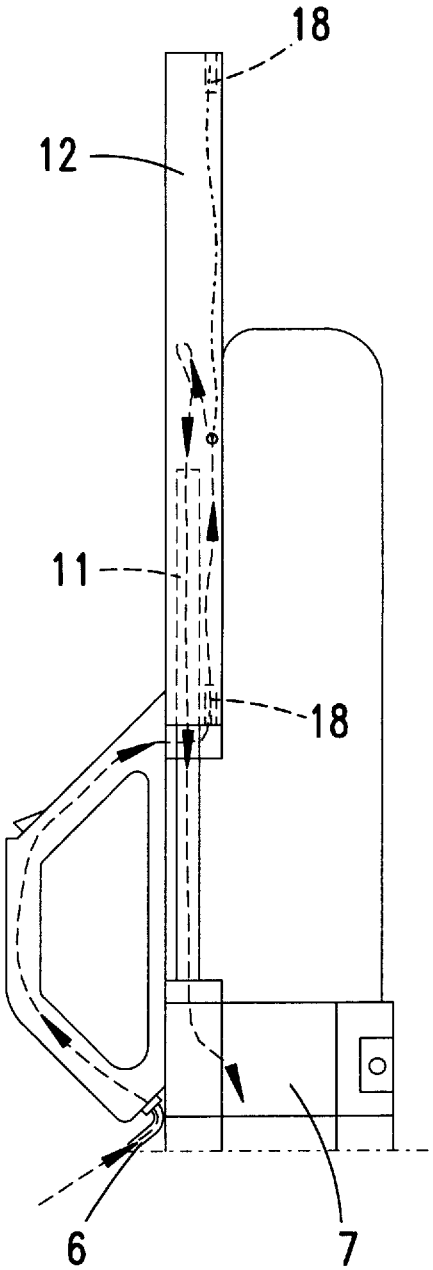
FIG. 11 is a diagrammatic view showing electrical connection between a hand grip via a telescoping handle to a motor housing with the grip located at a central portion of the telescopic handle adjacent the motor housing.
Figure 12:
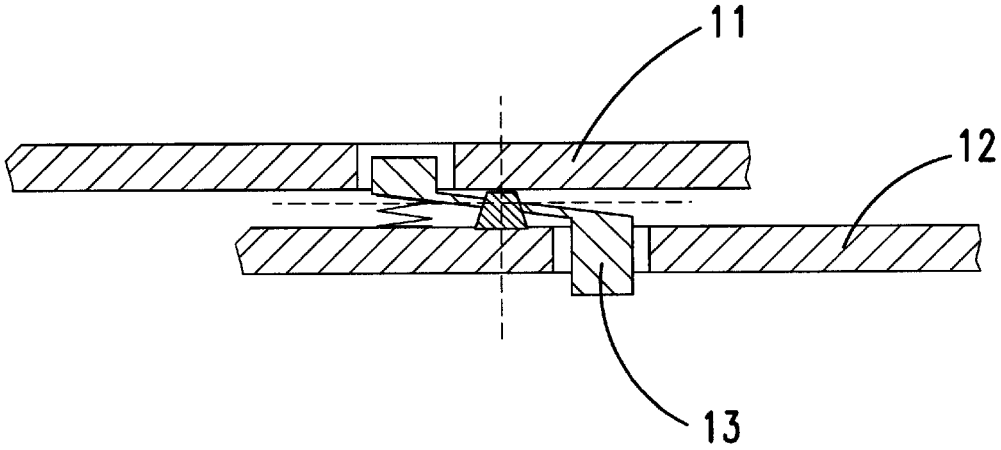
FIG. 12 is a fragmentary view of an interface between a base rod of the handle and a movable portion of the handle showing a latching arrangement.
Figure 13:
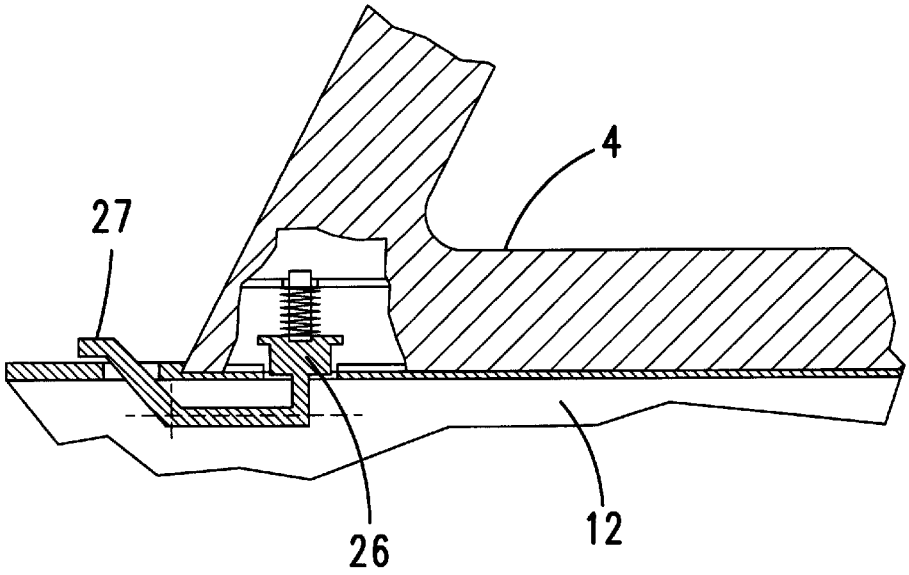
FIG. 13 is diagrammatic fragmentary view of a connection between the hand grip and the movable part of the handle wherein a lock button on the handle is located for releasing a spring loaded detent of the hand grip.

The hand grip 4, arranged in this manner, now lies in a favorable region close to the center of gravity of the motor housing 2, so that optimal handling of the vacuum cleaner 1 when working close to the floor or the like is present. In FIGS. 3 to 6, the vacuum cleaner 1, provided with the hand grip 4 arranged near the motor housing 2, is provided with a suction hose 28, shown in dashed line, for the vacuuming of cushions or the like. Particularly in this use, the arrangement of the hand grip 4 shown is of particular advantage since specifically with this work the vacuum cleaner 1 must frequently be carried. Electric cabling carrying power from the power supply to the motor follows a path which is clear from the connecting plug, through the hand grip 4 and the alternative plug connections 18, 25 of the hollow movable middle handle piece 12, to the transfer point and into the hollow base rod 11 for connection to the motor housing. Consequently, the current is supplied through a cable that runs through the telescoping handle sections 11, 12, the hand 12 having a plug-like pin 25 for connection as a lead to the movable middle handle piece 12. The current supply in this case is provided through the hand grip 4, provided with the current supply and the on/off switch 5, and also through the middle handle piece 12 that is connected with the hand grip 4 by the plug-like pin 25. The middle handle piece 12 has cable loops or the like which are guided through the instrument handle-base rod 11 into the motor housing 7. This is shown in FIGS. 10–11 corresponding to FIG. 2, and FIGS. 12–13 corresponding to FIG. 4, in which the respective lead guidance is presented in the "floor vacuum cleaner" operating mode FIGS. 10–11 and in the "above-floor vacuum cleaner" operating mode (FIGS. 12–13). The further path of the leads to the motor is not the subject of the present invention and can take a number of forms described in the prior art.

There is a clear interaction between locking button 13 and the holes visible in base rod 11. The locking button 13 is designed as a rocker, with the actuating knob of the locking button that projects out of the middle handle piece 12, as viewed in the operating direction, being offset from the axis of the locking pin that cooperates with the visible holes in the base rod 11 for locking. FIG. 12 shows the rocker arrangement described, such construction being known in the prior art.

In the latching of handle 4 with telescopic middle piece 12, latching detent projection 26 is not fixed, but is movable under spring action as shown in FIG. 13. Button 27 serves as a triggering button to unlock the latch. Upon actuation of the button 27, the button 27 pivots around a pivot point and pushes the latching detent projection 26 mounted in hand grip 4 out of the opening in the middle handle piece 12 against spring force. This releases the hand grip 4 which can be pulled off the middle handle piece 12.

What is claimed is:

1. A vacuum cleaning appliance operated by an electric motor, comprising:

a hand grip;

a telescopic handle fastened at an anchoring point on the appliance, the handle comprising a telescopic middle piece displaceably mounted relative to said anchoring point, and the hand grip is detachably mounted on the handle and is fastenable thereon between the telescopic middle piece and the anchoring point of the handle on the appliance.

2. A vacuum cleaning appliance according to claim 1, wherein the hand grip is also selectively detachably mounted on one end of the handle.

3. A vacuum cleaning appliance according to claim 1, wherein the handle further comprises a stationary base rod anchored to the appliance at the anchoring point, and said telescopic middle piece is displaceably mounted on said base rod.

4. A vacuum cleaning appliance according to claim 1, further comprising an electric power connection cord inserted into the hand grip and wherein feeding of current for the electric motor for operating the vacuum cleaning appliance is effected via said cord.

5. A vacuum cleaning appliance according to claim 1, wherein said telescopic middle piece has an electric connection, the hand grip has at least one plug-like pin engageable with the electric connection for electrical connection of the hand grip to said telescopic middle piece.

6. A vacuum cleaning appliance according to claim 5, wherein the telescopic middle piece has at both ends at least one receptacle for the plug-like pin, said receptacles constituting said electric connection.

7. A vacuum cleaning appliance according to claim 5, wherein the hand grip has an attachment flange on which the plug-like pin is formed, and said attachment flange is releasably attachable to said handle and is arranged eccentrically with respect to a lengthwise direction of the hand grip.

8. A vacuum cleaning appliance according to claim 7, wherein said hand grip is releasably attachable to said telescopic middle piece of said handle, and the eccentric arrangement of said attachment flange is such that there is only a small lengthwise overlap between said hand grip and said telescopic middle piece in an attached condition of said hand grip and said telescopic middle piece.

* * * * *